US010079444B2

(12) United States Patent
Tseng et al.

(10) Patent No.: US 10,079,444 B2
(45) Date of Patent: Sep. 18, 2018

(54) ELECTRICAL CONNECTOR HAVING CONDUCTIVE BALLS

(71) Applicant: FOXCONN INTERCONNECT TECHNOLOGY LIMITED, Grand Cayman (KY)

(72) Inventors: Wei-Ta Tseng, New Taipei (TW); Shun-Jung Chuang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 69 days.

(21) Appl. No.: 15/233,062

(22) Filed: Aug. 10, 2016

(65) Prior Publication Data

US 2017/0047673 A1 Feb. 16, 2017

(30) Foreign Application Priority Data

Aug. 10, 2015 (TW) ..... 104125871 A

(51) Int. Cl.
*H01R 12/00* (2006.01)
*H01R 13/24* (2006.01)
*H01R 12/71* (2011.01)

(52) U.S. Cl.
CPC ..... *H01R 13/2485* (2013.01); *H01R 12/714* (2013.01)

(58) Field of Classification Search
CPC .. H01R 13/2485; H01R 39/64; H01R 39/643; H01R 39/00; H01R 12/714
USPC ..... 439/17, 66, 81
See application file for complete search history.

(56) References Cited

U.S. PATENT DOCUMENTS

| | | | |
|---|---|---|---|
| 6,340,320 | B1 | 1/2002 | Ogawa |
| 7,817,003 | B2 | 10/2010 | Fullerton et al. |
| 7,999,645 | B2 | 8/2011 | Sarda |
| 8,758,025 | B1 | 6/2014 | Liljegren |
| 8,864,524 | B2 | 10/2014 | Sato |
| 9,300,070 | B2 | 3/2016 | Yoshikawa et al. |
| 2015/0126077 | A1 | 5/2015 | van Ekstrom |
| 2015/0288422 | A1 | 10/2015 | Fishman et al. |

FOREIGN PATENT DOCUMENTS

| | | |
|---|---|---|
| TW | M416902 | 11/2011 |
| TW | M466396 | 11/2013 |

*Primary Examiner* — Khiem Nguyen
(74) *Attorney, Agent, or Firm* — Wei Te Chung; Ming Chieh Chang

(57) ABSTRACT

An electrical connector includes an insulative housing defining a number of receiving grooves, a number of terminals secured to the insulative housing, and a number of conductive balls received in the receiving grooves. Each receiving groove defines a through hole. Each conductive ball is urged by a corresponding terminal to partially protrude from an associated through hole.

20 Claims, 4 Drawing Sheets

ELECTRICAL CONNECTOR HAVING CONDUCTIVE BALLS

BACKGROUND OF THE INVENTION

1. Field of the Invention

The present disclosure relates generally to an electrical connector, and more particularly to an electrical connector with a number of conductive balls.

2. Description of Related Arts

U.S. Patent Application Publication No. 20150288422 discloses a module phone comprising a framework enclosing a modular electronic device enablement system and coupling a plurality of modules and signals between the system and the modules are transferred by way of pogo pin connectors. U.S. Pat. No. 6,340,320 discloses an exemplary pogo pin connector. On the other hand, U.S. Pat. No. 8,864,524 discloses a contact of improved durability and reliability.

An electrical connector of an improved pogo pin style is desired.

SUMMARY OF THE INVENTION

Accordingly, an object of the present invention is to provide an electrical connector applied in a module phone with simple structure.

To achieve the above object, an electrical connector includes an insulative housing defining a plurality of receiving grooves, a plurality of terminals secured to the insulative housing, and a plurality of conductive balls received in the receiving grooves. Each receiving groove defines a through hole. Each conductive ball is urged by a corresponding terminal to partially protrude from an associated through hole.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1 to 4, an electrical connector 100 applied to a module phone is shown. The module phone may include a framework enclosing a flexible printed circuit or a printed circuit board 200 and detachably coupling a number of modules. The electrical connector 100 is used for transmitting signals between the modules and the printed circuit board 200.

Figure 1:
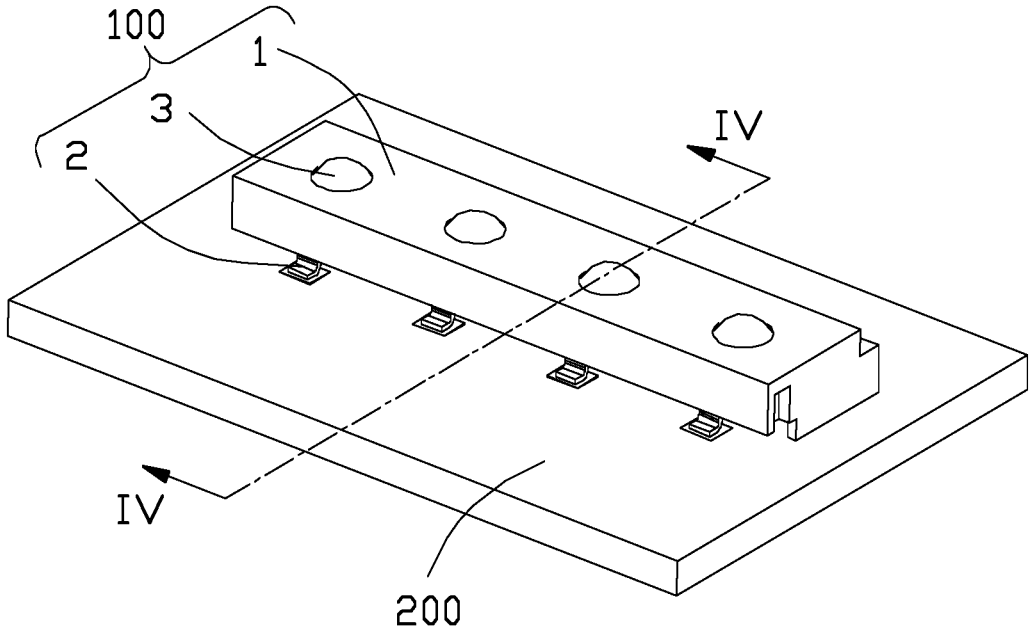
FIG. 1 is a perspective, assembled view of an electrical connector of the present invention mounted to a printed circuit board.
Figure 2:
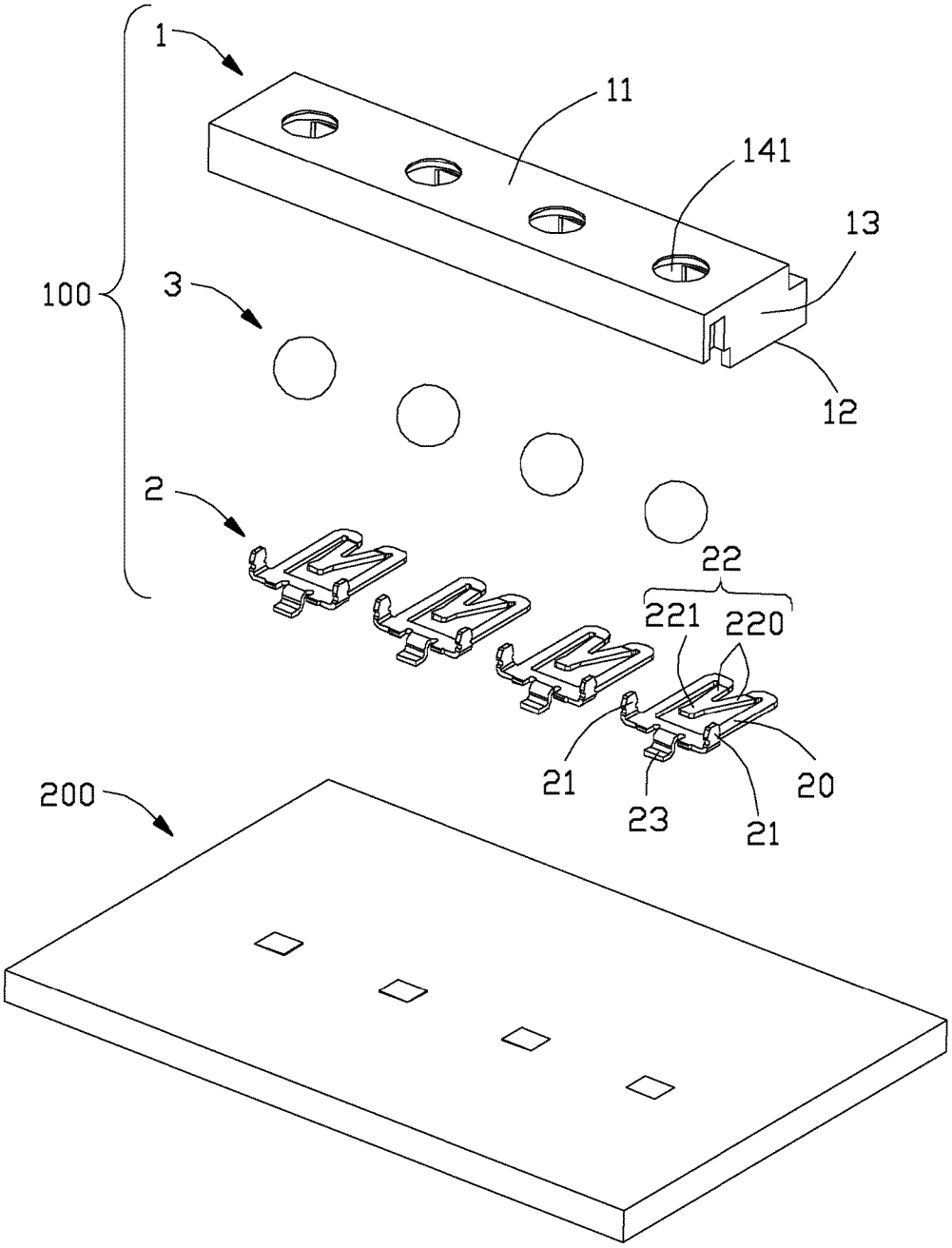
FIG. 2 is a perspective, exploded view of FIG. 1.
Figure 3:
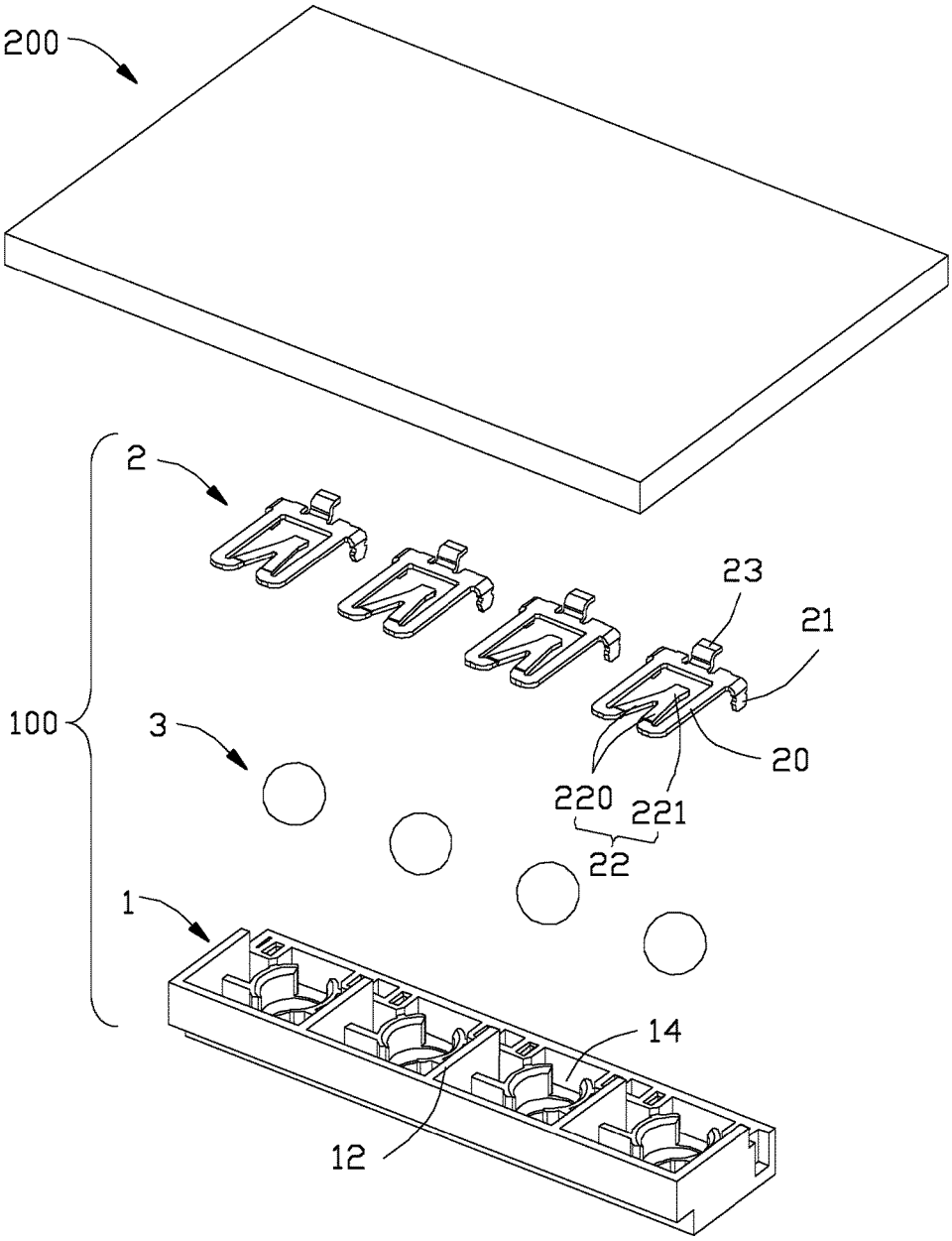
FIG. 3 is another view of FIG. 2.
Figure 4:
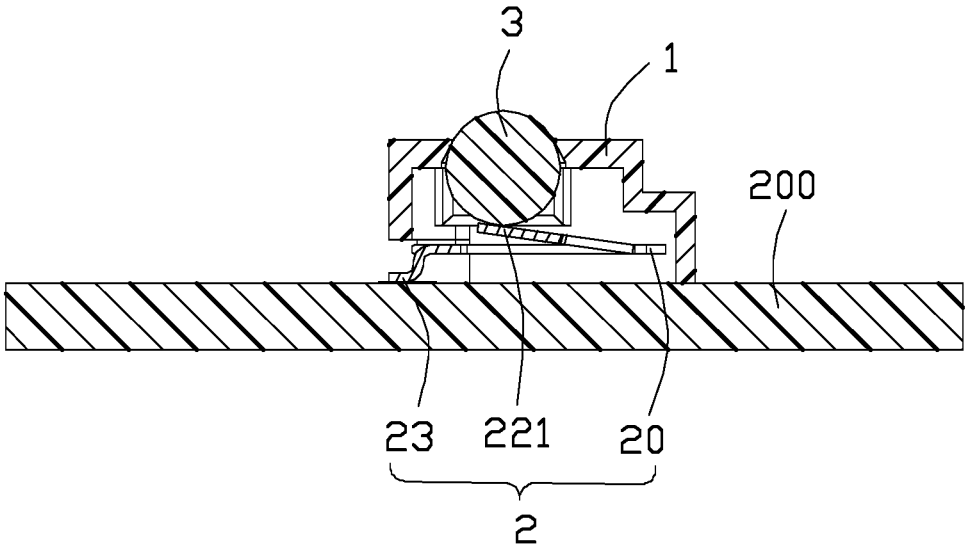
FIG. 4 is a cross-sectional view of the electrical connector taken along line IV-IV in FIG. 1.

Referring to FIGS. 2 to 4, the electrical connector 100 includes an insulative housing 1, a number of terminals 2 secured to the insulative housing 1 and a number of conductive balls 3. The insulative housing 1 defines a top surface 11, a bottom surface 12 positioned oppositely against the top surface 11 and a pair of side surfaces 13 connected with the top surface 11 and the bottom surface 12. The insulative housing 1 has a plurality of receiving grooves 14 extending through the top surface 11 and the bottom surface 12. Each receiving groove 14 defines a through hole 141 located at the top surface 11. And the diameters of the through holes 141 are smaller than that of the conductive balls 3. In the process of assembling, the conductive balls 3 are assembled into the receiving grooves 14 from the bottom surface 12 prior to assembling the terminals 2. The conductive balls 3 are received in the receiving grooves 14. Each conductive ball 3 is urged by a corresponding terminal 2 to partially protrude from an associated through hole 141.

Each terminal 2 comprises a base portion 20 extending in a horizontal direction, a pair of holding portions 21 bending from the base portion 20 and attached to the receiving groove 14, an elastic portion 22 extending upwardly from the base portion 20, a contact portion 221 located at one end of the elastic portion 22 and supportably contacted with the corresponding conductive ball 3, and a soldering portion 23 extending downwardly from the base portion 20. The holding portions 21 are located at two side surfaces of the soldering portion 23. The elastic portion 22 comprises a pair of elastic arms 220. And the contact portion 221 is connected with the two ends of the pair of elastic arms 220. The elastic portion 22 and the soldering portion 23 extend respectively from two ends of the base portion 20. And the elastic portion 22 extends to the soldering portion 23. The soldering portion 23 protrudes from the bottom surface 12 and is electrically connected with a printed circuit board 200. The conductive balls 3 received in the receiving grooves 14 are positioned above the contact portion 221. The conductive balls 3 protrude from the top surface 11 and are electrically connected with the modules.

When the modules are assembled to the framework, the modules compress the conductive balls 3 and the terminals 2. The elastic portions 22 deform elastically. The contacts of the modules are electrically connected with the terminals 2 stably.

The electrical connector 100 replaces the pogo pin connector comprising the terminals 2 received in the insulative housing 1 and the conductive balls 3. And the electrical connector 100 has a simple structure and a low manufacturing cost. The conductive balls 3 could seal the insulative housing 1 and prevent foreign intrusion. Notably, in this embodiment on one hand, the housing forms a plurality of small openings (not labeled) in the upper mating face and a plurality of large openings (not labeled) in the lower mounting face so as to ease assembling the conductive balls and the corresponding terminals into the corresponding receiving grooves upwardly and sequentially in a simple and convenient manner while still efficiently retaining the corresponding conductive ball after assembled, advantageously. On the other hand, the elastic portion extends horizontally in a cantilevered manner to replace the traditional coil spring so as to comply with the low profile housing, and the horizontally spanning base portion also provides stabilization, advantageously. In addition, each receiving groove has a tubular structure (not labeled) therein to snugly and compliantly receive the corresponding conductive ball when the conductive ball is downwardly pressed into the receiving groove.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing defining a plurality of receiving grooves, each receiving groove defining a through hole;

a plurality of terminals each having a holding portion fixedly secured to the insulative housing and an elastic portion; and a plurality of conductive balls received in the receiving grooves, each conductive ball flexibly urged by the elastic portion of a corresponding terminal to partially protrude from an associated through hole.

2. The electrical connector as claimed in claim 1, wherein said insulative housing defines a top surface and an opposite bottom surface, and the receiving grooves extend through the top surface and the bottom surface.

3. The electrical connector as claimed in claim 2, wherein said conductive balls are assembled into the receiving groove from the bottom surface prior to assembling the terminals.

4. The electrical connector as claimed in claim 2, wherein said through holes are located at the top surface, and the diameter of the though hole is smaller than that of the conductive ball.

5. The electrical connector as claimed in claim 1, wherein the terminal comprises a base portion, a contact portion, and a soldering portion, the holding portion bent from the base portion, the elastic portion extending upwardly from the base portion, the contact portion located at one end of the elastic portion and contacted with the conductive ball, the soldering portion extending downwardly from the base portion.

6. The electrical connector as claimed in claim 5, wherein the elastic portion and the soldering portion respectively extend from two opposite ends of the base portion.

7. The electrical connector as claimed in claim 5, wherein the elastic portion and the soldering portion extend toward a same direction.

8. The electrical connector as claimed in claim 5, wherein the elastic portion comprises a pair of elastic arms, and the contact portion is connected with the elastic arms.

9. The electrical connector as claimed in claim 5, wherein the conductive ball is positioned upon the contact portion.

10. An electrical connector assembly comprising:

a printed circuit board defining an upward surface in a vertical direction;

an insulative housing defining opposite mating face and mounting face in said vertical direction;

a plurality of terminals disposed in the housing, each of said terminals defining an elastic section, a contacting section extending from said elastic section in a supported manner, and a mounting section fixedly mounted upon the upward surface; and a plurality of conductive balls disposed in the housing and aligned with the corresponding terminals in the vertical direction, respectively, each of said conductive balls being upwardly supported by said contacting section with an upper portion upwardly located above and exposed upon the mating face in a floating manner; wherein said conductive ball is not only up and down moveable in the vertical direction but also essentially three-dimensionally self-rotatable with regard to the housing.

11. The electrical connector assembly as claimed in claim 10, wherein the housing defines a large opening in the mounting face to allow the conductive ball to be inserted upwardly into the housing, and a small opening in the mating face to allow the upper portion to upwardly extending therefrom to an exterior while still retained in the housing.

12. The electrical connector assembly as claimed in claim 10, wherein each of said terminals unitarily forms said elastic section, said contacting section and said mounting section.

13. The electrical connector assembly as claimed in claim 10, wherein each of said terminals forms a holding portion to retain the said terminal to the housing.

14. The electrical connector assembly as claimed in claim 13, wherein said holding portion is configured to be upwardly assembled to the housing.

15. The electrical connector assembly as claimed in claim 10, wherein said elastic section extends in a transversely cantilevered manner so as to comply with a low profile of the housing.

16. The electrical connector assembly as claimed in claim 10, wherein said housing forms a plurality of round tubular structures each to compliantly and snugly receive the corresponding conductive ball therein when said conductive ball is pressed downwardly into the housing while the corresponding terminal below said conductive ball essentially spans horizontally beyond said tubular structure in a top view for stabilization consideration.

17. An electrical connector assembly comprising:

an insulative housing defining opposite mounting and mating surfaces in a vertical direction, said mating face defining a small opening while said mounting face defining a large opening;

a plurality of terminals disposed in the housing, each of said terminals including an elastic section, a contacting section extending from the elastic section toward the mating face, and a mounting section extending around the large opening for mounting to a printed circuit board; and a plurality of conductive balls disposed in the housing corresponding to the terminals, respectively, each of said conductive balls being upwardly supported by said contacting section with an upper portion upwardly protruding beyond said small opening in a floating manner; wherein said conductive ball is not only up and down moveable in the vertical direction but also essentially three-dimensionally self-rotatable with regard to the housing.

18. The electrical connector assembly as claimed in claim 17, wherein the elastic section extends in a transversely cantilevered manner to comply with a lower profile of the housing.

19. The electrical connector assembly as claimed in claim 17, wherein each of said terminals defines a base section located around the mounting face and horizontally spanning beyond the corresponding conductive ball in a top view for stabilization consideration.

20. The electrical connector assembly as claimed in claim 19, wherein the housing forms a plurality of round tubular structures each to receive the corresponding conductive ball therein when said conductive ball is downwardly pressed while the base portion of the corresponding terminal below the conductive ball horizontally spans beyond said tubular structure in the top view.

* * * * *